US006045215A

United States Patent [19]

Coulman

[11] Patent Number: 6,045,215

[45] Date of Patent: Apr. 4, 2000

[54] HIGH DURABILITY INK CARTRIDGE PRINTHEAD AND METHOD FOR MAKING THE SAME

[75] Inventor: Donald J. Coulman, Corvallis, Oreg.

[73] Assignee: Hewlett-Packard Company, Palo Alto, Calif.

[21] Appl. No.: 08/919,492

[22] Filed: Aug. 28, 1997

[51] Int. Cl.[7] ..... B41J 2/01

[52] U.S. Cl. ..... 347/47; 347/45; 156/314; 156/319

[58] Field of Search ..... 347/47, 45; 156/319, 156/314

[56] References Cited

U.S. PATENT DOCUMENTS

| | | | |
|---|---|---|---|
| 4,146,585 | 3/1979 | Ward et al. | 525/102 |
| 4,179,537 | 12/1979 | Rykowski | 427/387 |
| 4,329,698 | 5/1982 | Smith | 347/68 |
| 4,497,890 | 2/1985 | Helbert | 430/296 |
| 4,500,895 | 2/1985 | Buck et al. | 347/87 |
| 4,509,062 | 4/1985 | Low et al. | 347/87 |
| 4,749,291 | 6/1988 | Kobayashi et al. | 400/124.1 |
| 4,771,295 | 9/1988 | Baker et al. | 347/87 |
| 4,794,409 | 12/1988 | Cowger et al. | 347/87 |
| 4,794,410 | 12/1988 | Taub et al. | 347/65 |
| 4,929,969 | 5/1990 | Morris | 347/87 |
| 4,937,172 | 6/1990 | Gervay | 430/280.1 |
| 4,944,850 | 7/1990 | Dion | 205/125 |
| 4,963,189 | 10/1990 | Hindagolla | 106/31.52 |
| 5,198,023 | 3/1993 | Stoffel | 106/31.32 |
| 5,198,834 | 3/1993 | Childers et al. | 347/65 |
| 5,278,584 | 1/1994 | Keefe et al. | 347/63 |
| 5,485,181 | 1/1996 | Convers | 347/63 |

OTHER PUBLICATIONS

Hewlett–Packard Journal, vol. 39, No. 4 (Aug. 1988).

*Primary Examiner*—John Barlow
*Assistant Examiner*—Christina Annick

[57] ABSTRACT

A high-durability printhead and method for making the same. A substrate is provided which includes an ink ejector system and a barrier layer. An orifice plate having a bottom surface made of an elemental noble metal [e.g. gold, platinum, and/or palladium] is affixed to the barrier layer using an adhesive produced by combining a mercapto oxysilane polymer and a trialkoxy silane coupling agent. To accomplish affixation, a mercapto trialkoxy silane is applied to the bottom surface of the orifice plate, followed by treatment of the plate with water to yield the mercapto oxysilane polymer. The mercapto oxysilane polymer may also be formed before delivery to the plate. The coupling agent is then applied to the polymer, thereby producing the adhesive. The orifice plate is then attached to the barrier layer using this adhesive. As a result, a unique printhead is produced having improved structural integrity.

13 Claims, 4 Drawing Sheets

HIGH DURABILITY INK CARTRIDGE PRINTHEAD AND METHOD FOR MAKING THE SAME

BACKGROUND OF THE INVENTION

The present invention generally relates to the production and design of ink cartridge units, and more particularly to an ink cartridge system having a high-durability printhead which includes an orifice plate structure fixedly secured to the printhead in a unique and effective manner.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve a cartridge which includes at least one ink reservoir chamber in fluid communication with a substrate (preferably made of silicon) having a plurality of thin-film heating resistors thereon. Selective activation of the resistors causes thermal excitation of the ink materials retained inside the ink cartridge and expulsion thereof from the cartridge. Representative thermal inkjet systems are discussed in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal*, Vol. 39, No. 4 (August 1988), all of which are incorporated herein by reference.

Another important component employed in thermal inkjet printing systems of the type described above (and in other ink cartridge systems using different ink expulsion systems aside from thin-film heating resistors) involves a structure known as an "orifice plate" which is also conventionally characterized as a "nozzle plate". The orifice plate is normally secured to the top portions of the printhead (e.g. above the ink expulsion components). To permit ink ejection from the orifice plate, the plate typically includes a number of openings or "orifices" passing entirely therethrough. Each of these orifices will have a representative diameter of about 0.01–0.05 mm, although this parameter may be varied as needed in accordance with the particular ink cartridge system under consideration. In a thermal inkjet printing system which employs a plurality of heating resistors to eject ink from the cartridge, each one of the openings in the orifice plate is in substantial alignment and registry with at least one of the thin film resistors in the printhead so that ink materials which are thermally excited (e.g. heated) during use of the ink cartridge can pass out of the printhead and orifice plate for delivery to a selected print media composition (e.g. paper).

Many different materials may be used to produce the orifice plate in an ink cartridge system, with the present invention not being restricted to any particular products for this purpose. However, representative and preferred materials suitable for fabricating the orifice plate include a rigid internal support member manufactured from, for example, elemental nickel (Ni), palladium/nickel alloys [Pd/Ni], or any other rigid, electroformable metals with engineerable properties. The support member is thereafter coated on both sides, along the outer peripheral edges thereof, and within the orifices with a protective metallic outer coating at an exemplary non-limiting thickness range of about 0.1–2.5 microns. Representative metallic coating compositions suitable for this purpose include but are not limited to elemental platinum (Pt), elemental palladium (Pd), elemental gold (Au), and mixtures thereof, with these metals being designated herein as "noble metals". In the alternative, the orifice plate may be constructed from a single metal composition (compared with the multi-component system listed above) configured in the shape of a flat panel member, with this structure being produced from one or more of the previously-described metals (e.g. elemental platinum (Pt), elemental palladium (Pd), elemental gold (Au), and mixtures thereof.) Again, as will become readily apparent from the additional information provided below, the claimed invention shall not be restricted to any particular construction materials in connection with the orifice plate unless otherwise noted herein. Likewise, more specific details concerning orifice plates in general will be provided in the Detailed Description of Preferred Embodiments section.

The orifice plate in an ink cartridge unit provides a number of important functions. For example, the orifice plate is designed to (1) protect the underlying components in the printhead including the ink ejectors [e.g. the thin-film resistors in a thermal inkjet printing system] from abrasion and other physical damage; (2) properly direct the flow of ink from the cartridge to a selected print media product [e.g. paper] in a cohesive, accurate, and controlled manner; and (3) provide a protective outer barrier which is used to control the corrosive effects of ink compositions which, depending on the ink product under consideration, can cause additional damage to the underlying printhead components. However, all of these important goals cannot be effectively achieved unless the orifice plate is fixedly secured to the printhead in a non-detachable manner so that it remains an integral and permanent part of the printhead. Premature disengagement or displacement of the orifice plate from the printhead will prevent the printhead (and cartridge unit) from properly functioning. It will then be necessary to discard the ink cartridge (and attached printhead) which is disadvantageous from an economic and practical standpoint.

Premature orifice plate detachment and/or misalignment typically occurs in accordance with the metallic character thereof (e.g. the use of noble metals and the like), and the difficulties which may be encountered in adhering this type of orifice plate in position using standard adhesive compositions. In a conventional and representative ink cartridge printhead (e.g. of the thermal inkjet variety) which will be discussed in substantial detail below, an underlying "substrate" is provided as previously noted which is typically manufactured from silicon. The operating components of the printhead (e.g. the "ink ejectors" which shall collectively involve the various components used to expel ink from the cartridge unit) are typically positioned directly on the substrate, along with the necessary conductive circuit elements (otherwise known as "traces") associated with the ink ejectors. In a thermal inkjet system, the ink ejectors will comprise a plurality of thin film resistors which are preferably made from a tantalum-aluminum composition known in the art for resistor fabrication. Again, further information regarding the substrate and various components which may be located thereon will be outlined below. Positioned on top of the substrate is an intermediate layer of barrier material (e.g. conventionally known as a "barrier layer") which performs may important functions. The barrier layer covers the conductive traces/circuit elements on the surface of the substrate, but is located between and around the ink ejectors (heating resistors) without covering them. As a result, ink expulsion chambers are formed directly above each ink ejector. In a thermal inkjet system, the ink expulsion chambers are typically characterized as "ink vaporization chambers". Within the individual ink expulsion chambers, ink materials are subjected to the necessary physical processes which enable them to be ejected from the cartridge unit. In a thermal inkjet system, ink materials are heated, vaporized, and subsequently expelled from the ink vaporization chambers through the orifices of the orifice plate.

The barrier layer is traditionally produced from conventional organic polymers [e.g. epoxies, and acrylates, epoxy-acrylate mixtures, photoresist materials, or other similar compositions as outlined in U.S. Pat. Nos. 4,794,410; 4,937,172; 5,198,834; and 5,278,485 which are incorporated herein by reference. Furthermore, the barrier layer is applied to the substrate using conventional processing methods including but not limited to standard photolithographic techniques which are known in the art for this purpose. More specific information regarding representative compositions which may be used to produce the barrier layer will likewise be discussed in considerable detail below. In addition to clearly defining the ink expulsion/vaporization chambers in the printhead, the barrier layer performs a number of other important functions including (1) electrical and chemical insulation of the underlying substrate and circuit traces thereon; and (2) enhancement of the overall strength and structural integrity of the entire printhead by imparting an additional degree of rigidity to the structure.

To complete the printhead manufacturing process, the orifice plate is thereafter placed on top of the barrier layer in a manner which allows substantial registry of the openings through the orifice plate with the underlying ink expulsion/vaporization chambers and ink ejectors therein (e.g. the thin-film resistors in a thermal inkjet printing system.) To ensure accurate ink delivery and maintain overall cartridge structural integrity, the orifice plate must be fixedly secured to the barrier layer in a non-detachable manner as discussed above. Otherwise, if secure attachment of these components does not take place, a number of problems can occur including (A) misdirected ink expulsion which will typically result in improperly printed images; (B) decreased cartridge life caused by the premature displacement of the orifice plate from the remainder of the printhead; and (C) decreased resistance of the printhead and its internal components to chemical deterioration which can more readily occur when the structural integrity of the printhead is compromised.

A number of different methods have been employed in order to secure the orifice plate to the barrier layer. These methods include but are not limited to the use of a separate layer containing one or more compositions that are designed to adhere the barrier layer to the orifice plate. Representative materials previously used for this purpose involve a number of chemical products including but not limited to uncured poly-isoprene photoresist which is applied using standard photolithographic and other known methods as discussed in U.S. Pat. No. 5,278,584 (incorporated by reference). Likewise, the use of photoresist materials for this purpose is discussed in U.S. Pat. No. 5,198,834 which is also incorporated by reference. U.S. Pat. No. 5,198,834 describes the application of a photoresist composition sold under the name "Waycoat SC Resist 900" (Catalog No. 839167) by Olin Hunt Specialty Products, Inc. which is a subsidiary of the Olin Corporation of West Paterson, N.J. (USA). This composition is diluted with a product known as "Waycoat PF Developer" (Catalog No. 840017) and thereafter developed using "Waycoat Negative Resist Developer" (Catalog No. 837773), with both of these materials likewise being sold by Olin Hunt Specialty Products, Inc. as previously noted. Other materials which have been employed as adhesive compounds to attach the orifice plate to the barrier layer include but are not limited to polyacrylic acid, as well as acrylate and epoxy-based adhesives.

Notwithstanding the developments listed above, a need remains for a method which enables secure and permanent affixation of the orifice plate to the underlying barrier layer in a printhead. This need is especially important in connection with orifice plate structures that are comprised of and/or coated with elemental noble metals (e.g. gold [Au], platinum [Pt], palladium [Pd], and the like). Secure adhesion of these materials to the polymeric compositions which are typically used to manufacture the barrier layer has traditionally presented a number of difficult problems as previously noted. The present invention involves a unique adhesive system which is designed to avoid these problems and fixedly adhere the orifice plate to the barrier layer in a strong, secure, and permanent manner. The materials and methods of the invention likewise avoid problems associated with premature orifice plate detachment caused by the corrosive/degenerative effects of the ink materials being delivered. The present invention therefore provides an orifice plate attachment system with superior adhesion characteristics compared with previous attachment methods. As a result, the overall life of the entire ink cartridge is substantially prolonged, along with the maintenance of high print quality levels. All of these benefits and advantages will become readily apparent from the specific description of the invention set forth below which represents a significant advance in the art of ink cartridge technology.

SUMMARY OF THE INVENTION

It is an object of the present invention to provide an ink cartridge printhead of improved design and operating efficiency.

It is another object of the invention to provide an ink cartridge printhead having high-durability characteristics.

It is another object of the invention to provide a high-durability ink cartridge printhead which is characterized by an improved degree of structural integrity.

It is another object of the invention to provide a high-durability ink cartridge printhead which is also characterized by a consistent level of print quality over the life of the ink cartridge.

It is another object of the invention to provide a high-durability ink cartridge printhead which has a long functional life resulting from an improved level of structural integrity.

It is another object of the invention to provide a high-durability ink cartridge printhead which avoids problems associated with the corrosive effects of ink compositions.

It is another object of the invention to provide a high-durability ink cartridge printhead in which the overall structural integrity of the printhead is improved through the use of a unique chemical attachment system designed to permanently secure the orifice plate to the underlying barrier layer associated with the printhead.

It is a further object of the invention to provide a high-durability ink cartridge printhead in which the orifice plate of the printhead is attached to the underlying material layers in a manner which avoids premature orifice plate detachment during use of the cartridge.

It is a still further object of the invention to provide a high-durability ink cartridge printhead in which the orifice plate of the printhead is fixedly attached to the underlying material layers of the printhead in a permanent and secure manner notwithstanding the use of an orifice plate comprised of and/or coated with one or more noble metals.

It is a still further object of the invention to provide a high-durability ink cartridge printhead which utilizes thermal inkjet technology.

It is an even further object of the invention to provide a unique method for producing the printhead described above which is characterized by all of the foregoing benefits.

The specialized printhead system and production method of the claimed invention will now be summarized. More detailed information along with a discussion of specific construction materials and processing parameters will be provided below in the Detailed Description of Preferred Embodiments section.

As noted above, the present invention involves a high-durability printhead system and production methods which provide numerous important benefits. These benefits include greater overall structural integrity and the more secure adhesion of components made of, for example, noble metals (e.g. the orifice plate, circuit traces on the printhead substrate, and the like) to other parts of the printhead. Traditionally, components produced from elemental noble metals (e.g. gold [Au], platinum [Pt], palladium [Pd], and mixtures thereof) have presented adhesion problems when conventional adhesive compositions are employed. The present invention effectively overcomes these problems by providing a unique and highly-effective adhesive-type coupling system which securely bonds the components of interest to other portions of the printhead unit. As will become readily apparent from the discussion provided below, this goal is achieved through the use of a process which actually involves a bi-layer adhesion/coupling system particularly designed for use with noble metal components (particularly gold). Using this system, these parts are securely attached to the printhead in order to produce a final structure that is characterized by greater shock-resistance and the avoidance of premature component detachment (which is especially important in connection with the orifice plate at the front of the printhead).

At the outset, it is important to emphasize that the present invention shall not be restricted to the use of the claimed printhead with any particular type of ink cartridge or ink storage/delivery system. The claimed printhead is prospectively applicable to systems in which the printhead is directly attached to the cartridge of interest or attached using an appropriate fluid transfer conduit assembly to a remotely-positioned ink reservoir chamber. In this regard, the claimed products and processes may be used in connection with a wide variety of different ink storage devices.

In accordance with a preferred embodiment of the invention, a unique printhead structure and construction method are disclosed which enable the orifice plate (or "nozzle plate") of the printhead to be securely and permanently attached in position, notwithstanding the use of noble metals to manufacture the orifice plate. As a result, printhead longevity is substantially improved compared with prior systems. To produce the printhead, a substrate is initially provided which is manufactured of, for example, silicon as outlined in greater detail below. The substrate (which has an upper surface) is designed to retain the operating components of the printhead assembly thereon. Specifically, the upper surface of the substrate comprises at least one and preferably multiple ink ejectors thereon. The term "ink ejector" as used herein shall encompass any component, element, device, or structure which is capable of expelling ink materials on-demand from the printhead. While the present invention shall be described herein with primary reference to thermal inkjet technology, many other technologies may be associated with the ink ejectors of interest. In a thermal inkjet printing system, a plurality of thin-film heating resistors are provided on the upper surface of the substrate, with the resistors typically being of the tantalum-aluminum variety. Each of the thin-film heating resistors functions as an "ink ejector" for controlled ink expulsion from the printhead. Other devices which may be employed in connection with the ink ejectors of the present invention include but are not limited to piezoelectric elements and the like. The upper surface of the substrate may likewise include a plurality of logic transistors and metallic circuit traces (conductive pathways/elements) which electrically communicate with the resistors (or other ink ejectors) so that they may be activated in a controlled manner. As discussed in greater detail below, these circuit traces may be fabricated from one or more elemental noble metals. Of particular interest is the use of gold for this purpose.

Also positioned on at least a portion of the upper surface of the substrate is a layer of barrier material. Many different compositions may be used to produce the barrier material, with the present invention not be restricted to any particular products for this purpose. Representative compounds suitable for use in manufacturing the layer of barrier material include but are not limited to: 1) dry photoresist films containing half acrylol esters of bis-phenol; 2) epoxy monomers; 3) acrylic and melamine monomers [e.g. which are sold under the trademark "Vacrel" by E.I. DuPont de Nemours and Company of Wilmington, Del. (USA)]; 4) epoxy-acrylate monomers [e.g. which are sold under the trademark "Parad" by E.I. DuPont de Nemours and Company of Wilmington, Del. (USA)]. All of these materials have a number of common features including an organic character, as well as the capability to create the fine resolution necessary to produce an efficiently-operating printhead either through standard lithographic processing technologies or other methods (e.g. micromolding and the like). The above materials are also thermally/dimensionally stable, and capable of withstanding chemical attack from ink materials. In thermal inkjet systems (which are of primary interest in this case), the barrier layer is applied between and around the ink ejectors (e.g. resistors) without covering them. As a result, an ink expulsion/vaporization chamber is formed directly above each resistor as discussed in considerable detail below. Within each chamber, ink materials are heated, vaporized, and subsequently expelled from the printhead.

The barrier layer is applied to the upper surface of the substrate using standard photolithographic techniques or other methods known in the art for this purpose. In addition to clearly defining the vaporization chambers, the barrier layer also functions as a chemical and electrical insulating layer relative to the circuit traces, logic transistors, and other comparable elements on the substrate as noted above. Likewise, the barrier layer imparts added strength and structural integrity to the printhead.

Next, an orifice plate member is provided. The orifice plate member functions as a nozzle structure for the controlled, direction-specific delivery of ink onto a selected print media material (e.g. paper) during expulsion from the printhead. The orifice plate member comprises a bottom surface and a plurality of openings or "orifices" which pass entirely through the plate. In accordance with the present invention, the bottom surface of the orifice plate member is comprised of a selected elemental noble metal selected from the group consisting of elemental gold [Au], elemental platinum [Pt], elemental palladium [Pd], and mixtures thereof. Regarding the phrase "having a bottom surface comprised of at least one noble metal", this feature of the invention can be accomplished in many ways. For example, an orifice plate may be provided which consists entirely of the elemental noble metal under consideration so that, when viewed in cross-section, the plate will have a substantially uniform metallic character. Being constructed of a single component, this structure will necessarily have a bottom surface comprised of the noble metal of interest. However, in a preferred embodiment, the orifice plate member will consist of an internal plate-like support member made of rigid, strength-imparting material (e.g. nickel [Ni], palladium/nickel alloys [Pd/Ni], or any other rigid, electroformable metals with engineerable properties) which is uniformly coated on all sides (or at least the bottom surface) and within the orifices with a selected elemental noble metal as defined above. As a result, the bottom surface of the orifice plate member will again be comprised of at least one noble metal. Accordingly, this phrase shall be construed to encompass many different orifice plate structural designs provided that, in some manner, the bottom surface of the plate member is made of the selected elemental noble metal. Noble metal materials are desired for use in constructing the orifice plate structure in view of their corrosion resistance (e.g. resistance to the deteriorating effects of ink compositions), abrasion resistance, and overall inert character. Further information concerning the orifice plate member (including dimensions and other features) will be presented below in the Detailed Description of Preferred Embodiments section.

At this point, the orifice plate member is secured in position on top of the layer of barrier material. Regarding orifice plate members comprised entirely or partially of at least one elemental noble metal on the bottom surface thereof as previously noted [e.g. gold, platinum and/or palladium], prior attachment methods involving the use of conventional adhesive materials have resulted in inadequate adhesion of the orifice plate to the barrier layer. This problem adversely effected the overall structural integrity of the entire printhead. The present invention involves a unique, effective, and permanent method for affixing noble metal-type orifice plates to organic polymeric barrier materials so that a high-durability printhead can be produced. This method will now be outlined. First, at least a portion of the bottom surface of the orifice plate member (which is comprised of at least one elemental noble metal as defined above), is coated with a material designated herein as a "mercapto trialkoxy silane composition" in order to form a primary adhesion layer comprised of this material on the bottom surface of the orifice plate. This composition strongly interacts with the selected noble metal (especially gold) and, as discussed in considerable detail below, forms an intermetallic bond between the sulfur associated with the mercapto trialkoxy silane composition and the noble metal under consideration. The term "mercapto trialkoxy silane composition" shall be defined to encompass the following chemical structure:

$$(RO)_3Si(CH_2)_nSH$$

While the claimed invention shall not be restricted to any particular parameters in connection with "n" and "R" in this formula, a representative and preferred embodiment will involve a composition wherein (1)n=2–6; and (2) R is selected from the group consisting of —$CH_3$ (methyl) and —$CH_2CH_3$ (ethyl).

Next, the selected mercapto trialkoxy silane composition in the primary adhesion layer is chemically converted to a compound known as a "mercapto oxysilane polymer", with this particular composition involving an oxygen-linked multi-silane compound which is further discussed below and illustrated in the drawing figures. Chemical conversion of the mercapto trialkoxy silane composition to the mercapto oxysilane polymer may be achieved in many ways, although conversion will preferably take place by applying water ($H_2O$) directly to the primary adhesion layer which contains the selected mercapto trialkoxy silane compound. Water application can be undertaken by the direct delivery of water (or water-containing solutions) to the primary adhesion layer or by placing the primary adhesion layer on the orifice plate member in contact with steam.

In addition, it shall be understood that production of the mercapto oxysilane polymer from the mercapto trialkoxy silane compound may be undertaken (1) after application and bonding of the selected mercapto trialkoxy silane composition to the bottom surface of the orifice plate member (which is comprised of at least one elemental noble metal as discussed above); or (2) prior to delivery of the mercapto trialkoxy silane composition to the bottom surface of the orifice plate member. When process (2) is employed, the mercapto trialkoxy silane composition is first chemically converted to the desired mercapto oxysilane polymer by the addition of water thereto, followed by delivery of the conversion product (e.g. the mercapto oxysilane polymer) to the bottom surface of the orifice plate member. As a result, an orifice plate structure is produced having a bottom surface comprised of at least one elemental noble metal (e.g. gold, platinum, and/or palladium) which further comprises a coating of the mercapto oxysilane polymer thereon, with the sulfur groups in this compound being bonded to the noble metal. However, both of these methods shall be deemed equivalent in function, result, and operative effect.

Next, at least a portion of the primary adhesion layer on the bottom surface of the orifice plate member (which contains the mercapto oxysilane polymer thereon), is coated with a selected trialkoxy silane coupling agent in order to form a secondary adhesion layer positioned on the primary adhesion layer and chemically bonded thereto. The term "trialkoxy silane coupling agent" shall be defined to encompass the following chemical structure:

$$(R^1O)_3Si(CH_2)_mR^2$$

While the claimed invention shall not be restricted to any particular parameters in connection with "m", "$R^1$", and "$R^2$" in this formula, a representative and preferred embodiment will involve a composition wherein (1)m=2–6; (2) $R^1$ is selected from the group consisting of —$CH_3$ (methyl) and —$CH_2CH_3$ (ethyl); and (3) $R^2$ is selected from the following group:

A) —CN (cyano)

B) —OH (hydroxy)

C) —SH (mercapto)

D) —OCN (isocyanato)

E) —$NH_2$ (amino)

F) —HC═$CH_2$ (allyl)

G) —O(C=O)$CH_3$ (acetoxy)

H) —O(C=O)CHC═$CH_2$ (acryloxy)

I) —(C=O)O$CH_3$ (carbomethoxy)

-continued

J) 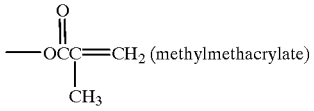

K) 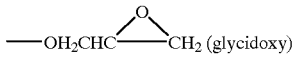

In the foregoing manner, the primary and secondary adhesion layers chemically bond to each other and combine to form a composite adhesive layer (e.g. a portion or supply of adhesive material). The resulting composite adhesive material/layer involves an amorphous network-like structure of interconnected silane compositions that is not entirely subject to characterization using conventional chemical nomenclature. In this regard, the resulting composite adhesive material is more accurately and best characterized as the "reaction product" which occurs when the mercapto oxysilane polymer is combined with the selected trialkoxy silane coupling agent. It should also be noted that, during application of the primary and secondary adhesion layers to form the composite adhesive layer, such materials shall be selectively applied to the bottom surface of the orifice plate so that they do not cover (e.g. block) the orifices.

Finally, to complete the assembly process, the secondary adhesion layer on the bottom surface of the orifice plate member is placed in direct physical contact (e.g. engagement) with the layer of barrier material on the substrate in order to securely affix the orifice plate member to the layer of barrier material with the composite adhesive composition therebetween. As a result, a high-durability printhead is produced in which the orifice plate is fixedly secured in position notwithstanding its noble metal character. This goal is achieved through the unique chemical interactions described above which effectively couple the orifice plate member and layer of barrier material together in a highly effective and permanent manner.

The final printhead product will therefore include the following structural components: (1) a substrate having an upper surface with the upper surface including at least one ink ejector thereon as previously discussed (which will involve one or more resistors in a thermal inkjet system); (2) a layer of barrier material positioned on at least a portion of the upper surface of the substrate; (3) a portion (e.g. layer or supply) of composite adhesive material positioned on the layer of barrier material, with the adhesive material being comprised of a reaction product formed by the combination of a mercapto oxysilane polymer and a trialkoxy silane coupling agent; and (4) an orifice plate member having at least one opening therethrough and a bottom surface comprised of at least one elemental noble metal selected from the group consisting of gold, platinum, and/or palladium with the bottom surface of the orifice plate member being affixed to the adhesive material so that the adhesive material is positioned between the orifice plate member and the layer of barrier material.

As discussed in further detail below, an ink cartridge may be produced using the claimed printhead by initially providing a housing comprising a compartment therein which is designed to retain a supply of ink. The printhead of the present invention which includes elements (1)–(4) listed above is then operatively connected (e.g. directly or remotely attached) to the housing so that the printhead is in fluid communication with the compartment in the housing.

Compared with prior printhead designs, the claimed structure is characterized by a number of benefits. These benefits include but are not limited to: (A) a greater degree of strength, durability, and shock resistance; (B) improved printhead longevity; (C) more uniform print quality and reliability over the life of the printhead; (D) enhanced corrosion resistance; and (E) an improved level of overall structural integrity. Accordingly, the present invention represents a significant advance in the art of ink printing technology. These and other objects, features, and advantages of the invention will be discussed below in the following Brief Description of the Drawings and Detailed Description of Preferred Embodiments.

DETAILED DESCRIPTION OF PREFERRED EMBODIMENTS

Figure 1:
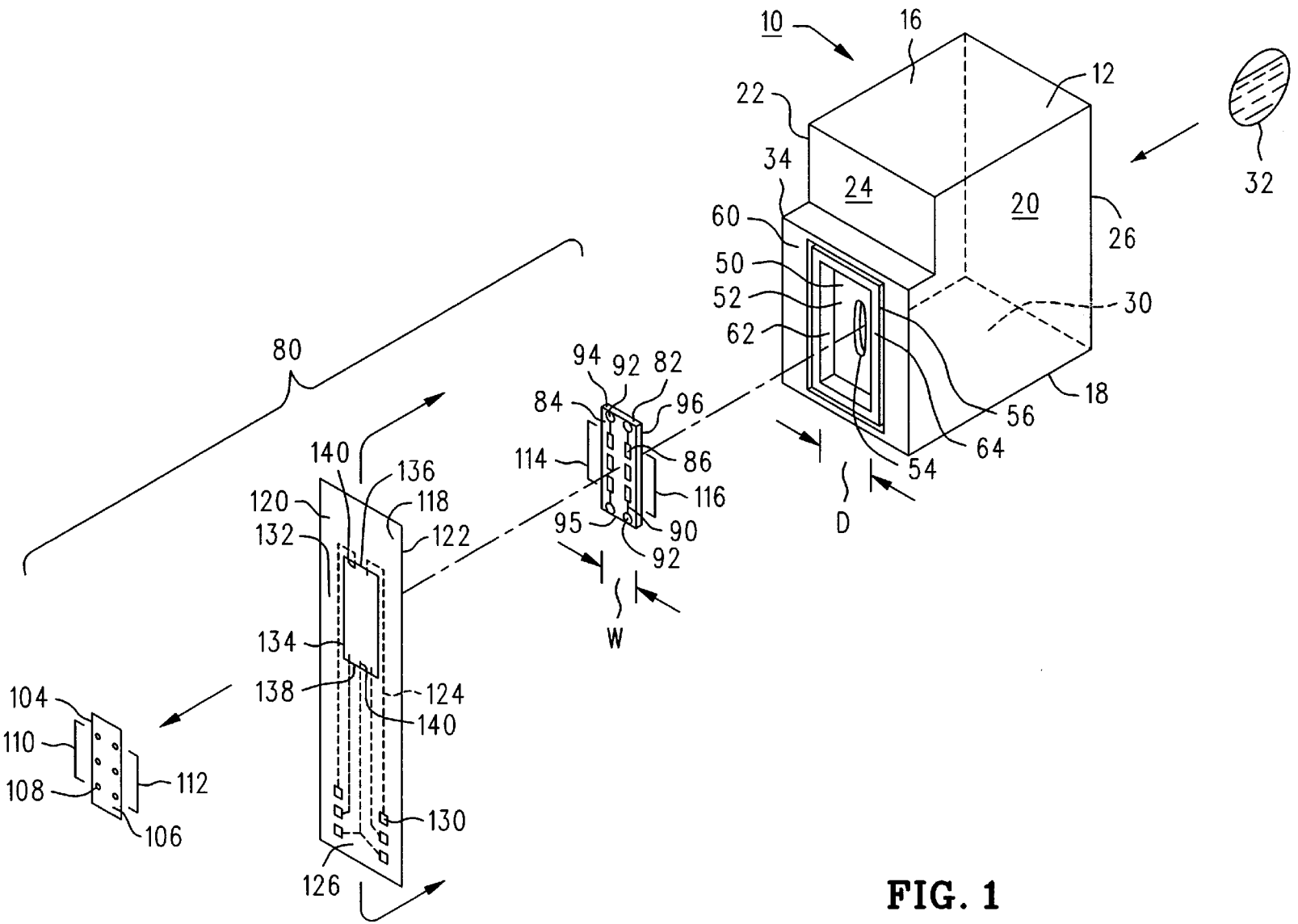
FIG. 1 is a schematically-illustrated exploded perspective view of a representative ink cartridge suitable for use in accordance with the present invention.

As discussed in detail below, the present invention involves a high-durability ink cartridge system in which a noble metal-containing orifice plate is securely affixed to the underlying printhead components (e.g. the barrier layer) in a highly effective and permanent manner. Premature displacement and/or detachment of the orifice plate is therefore prevented which results in prolonged cartridge life. To accomplish this goal, a specialized chemical coupling system is provided which enables the orifice plate to be securely affixed to the underlying portions of the printhead. In this manner, the overall structural integrity, durability, and resistance of the printhead to the corrosive effects of ink compositions are substantially improved compared with prior adhesion systems. The claimed product and process represent a considerable advance in the art of ink cartridge design. While the present invention shall be described below with primary reference to thermal inkjet technology, many different ink cartridge systems may be employed in connection with the specialized adhesion/coupling system of the invention, provided that the selected cartridge includes a housing with an internal compartment, a printhead in fluid communication with the compartment, and at least one ink ejector associated with the printhead. It should also be emphasized that the term "ink ejector" shall again involve any component, device, element, or structure which may be used to expel ink on-demand from the printhead. For example, in a thermal inkjet printing system, "ink ejector"

will encompass the use of one or more selectively-energizable thin-film heating resistors as outlined in greater detail below. In this regard, the materials, methods, and structures of the invention are not "cartridge-specific" which will become readily apparent from the detailed discussion presented herein. To provide a clear and complete understanding of the invention, the following description will be divided into three sections, namely, (1) "A. An Overview of Thermal Inkjet Technology"; (2) "B. The Orifice Plate"; and (3) "C. The Orifice Plate Attachment System."

A. An Overview of Thermal Inkjet Technology

The present invention is again applicable to a wide variety of ink cartridge systems which include (1) a housing having an internal compartment or chamber therein; (2) a printhead attached (e.g. directly or remotely connected) to the housing and in fluid communication with the chamber; and (3) at least one "ink ejector" associated with the printhead. As previously noted, the term "ink ejector" is defined to encompass any component, system, or device which selectively ejects or expels ink on-demand from the printhead. Thermal inkjet cartridges which use multiple heating resistors as ink ejectors are preferred for this purpose. However, the claimed invention shall not be restricted to any particular ink ejectors or inkjet printing technologies as noted above. Instead, a wide variety of different ink delivery devices may be encompassed within the claimed invention including but not limited to piezoelectric drop systems of the general type disclosed in U.S. Pat. No. 4,329,698 to Smith, dot matrix systems of the variety described in U.S. Pat. No. 4,749,291 to Kobayashi et al., as well as other comparable and functionally equivalent systems designed to deliver ink using one or more ink ejectors. The specific operating components associated with these alternative systems (e.g. the piezoelectric elements in the system of U.S. Pat. No. 4,329,698) shall be encompassed within the term "ink ejectors" as previously noted.

To facilitate a complete understanding of the claimed invention as it applies to thermal inkjet technology (which is the preferred system of primary interest), an overview of thermal inkjet technology will now be provided. A representative thermal inkjet cartridge unit is illustrated in FIG. 1 at reference number 10. It shall be understood that cartridge 10 is presented herein for example purposes and is non-limiting. In addition, cartridge 10 is shown in schematic format in FIG. 1, with more detailed information regarding cartridge 10 and its various features being provided in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal*, Vol. 39, No. 4 (August 1988), all of which are incorporated herein by reference.

With continued reference to FIG. 1, the cartridge 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 further includes a front wall 24. Surrounded by the front wall 24, top wall 16, bottom wall 18, first side wall 20, and second side wall 22 is an interior chamber or compartment 30 within the housing 12 (shown in phantom lines in FIG. 1) which is designed to retain a supply of an ink composition 32 therein (either in liquid [uncontained] form or retained within an absorbent foam-type member [not shown]). The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to housing 12 of the ink cartridge 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). The first main component used to produce the printhead 80 consists of a substrate 82 preferably manufactured from silicon. Secured to the upper surface 84 of the substrate 82 using conventional thin film fabrication techniques is a plurality of individually-energizable thin-film resistors 86 which function as "ink ejectors" and are preferably fabricated from a tantalum-aluminum composition known in the art for resistor construction. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 (e.g. circuit elements) which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below.

Many different materials and design configurations may be used to construct the resistor assembly 96, with the present invention not being restricted to any particular elements, materials, and components for this purpose. However, in a preferred, representative, and non-limiting embodiment, the resistor assembly 96 will be approximately 0.5 inches long, and will likewise contain 300 resistors 86 thus enabling a resolution of 600 dots per inch ("DPI"). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86 as discussed further below. It should also be noted that the substrate 82 may include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contract regions 92 and traces 90) formed on the substrate 82. Other features of the substrate 82 (e.g. the resistor assembly 96) will be presented below.

Securely affixed to the upper surface 84 of the substrate 82 (with a number of intervening material layers therebetween including a barrier layer and the specialized compositions of the present invention as outlined below) is the second main component of the printhead 80. Specifically, an orifice plate 104 is provided as shown in FIG. 1 which is used to distribute the selected ink compositions to a designated print media material (e.g. paper). In accordance with the claimed invention, the orifice plate 104 consists of a panel member 106 (shown schematically in FIG. 1) which is manufactured from one or more metal compositions. The specific metals which are suitable for this purpose, as well as additional details involving the dimensions and other parameters associated with the orifice plate 104/panel member 106 will be provided in the next section. The orifice plate 104 further comprises at least one and preferably a plurality of openings or "orifices" therethrough which are designated at reference number 108. These orifices 108 are shown in enlarged format in FIGS. 1–4. Each orifice 108 in a representative embodiment will have a diameter of about 0.01–0.05 mm. In the completed printhead 80, all of the components listed above are assembled so that each of the orifices 108 is aligned with at least one of the resistors 86 (e.g. "ink ejectors") on the substrate 82. As result, energization of a given resistor 86 will cause ink expulsion from the desired orifice 108 through the orifice plate 104. The claimed invention shall not be limited to any particular size, shape, or dimensional characteristics in connection with the orifice plate 104 and shall likewise not be restricted to any number or arrangement of orifices 108. In a representative embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further information concerning this type of metallic orifice plate system is provided in, for example, U.S. Pat. No. 4,500,895 to Buck et al. which is incorporated herein by reference.

It should also be noted that, while the primary embodiment of the invention is applicable to orifice plates produced from metal compositions, alternative printing systems have effectively employed orifice plate structures constructed from non-metallic organic polymer compositions, with these structures typically having a representative and non-limiting thickness of about 1.0–2.0 mil. In this context, the term "non-metallic" will encompass a product which does not contain any elemental metals, metal alloys, or metal amalgams. The phrase "organic polymer" shall involve a long-chain carbon-containing structure of repeating chemical subunits. A number of different polymeric compositions may be employed for this purpose. For example, non-metallic orifice plate members may be manufactured from the following compositions: polytetrafluoroethylene (e.g. Teflon®), polyimide, polymethyl-methacrylate, polycarbonate, polyester, polyamide polyethyleneterephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by the DuPont Corporation of Wilmington, Del. (USA). Further data regarding the use of non-metallic organic orifice plate systems is provided in U.S. Pat. No. 5,278,584.

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with representative (non-limiting) examples including polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing the flexible circuit member 118 is a product sold under the trademark "KAPTON" by the DuPont Corporation of Wilmington, Del. (USA) as noted above. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit (not shown) to the resistors 86 (or other ink ejectors) on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals from the printer unit (not shown) can then travel via the conductive traces 90 on the substrate 82 to the resistors 86 so that on-demand heating (energization) of the resistors 86 can occur.

It is important to emphasize that the present invention shall not be limited to the specific printhead 80 illustrated in FIG. 1 and discussed above, with many other printhead designs also being suitable for use in accordance with the claimed invention. The printhead 80 of FIG. 1 is provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The final step in producing the completed printhead 80 involves attachment of the orifice plate 104 in position on the underlying portions of the printhead 80 so that the orifices 108 are in precise alignment with the resistors 86 on the substrate 82. As previously noted in connection with the representative cartridge 10 shown in FIG. 1, additional layers of material are typically present between the orifice plate 104 and resistor assembly 96 (e.g. substrate 82 with the resistors 86 thereon). These additional layers perform various important functions including electrical insulation, adhesion of the orifice plate 104 to the resistor assembly 96, and the like. These additional layers (which are not shown in FIG. 1) will be discussed below in connection with the unique and highly effective attachment system of the present invention that is used to secure the orifice plate 104 in position.

B. The Orifice Plate

Figure 2:
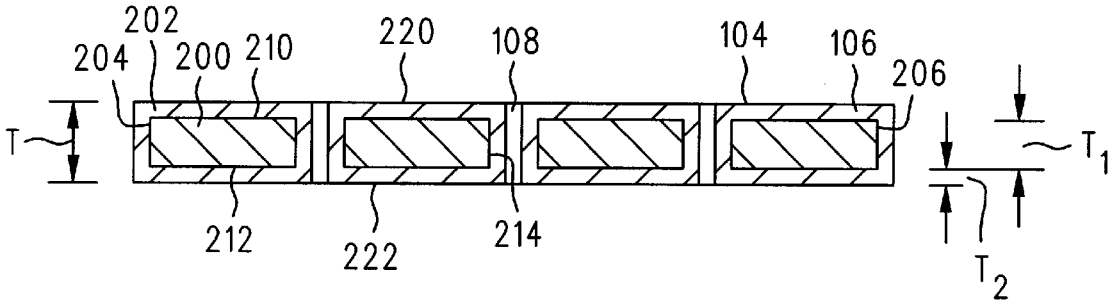
FIG. 2 is a schematically-illustrated cross-sectional view in enlarged format of a representative multi-component orifice plate member which may be used in accordance with the invention, with the view of FIG. 2 passing through one row of orifices.
Figure 3:
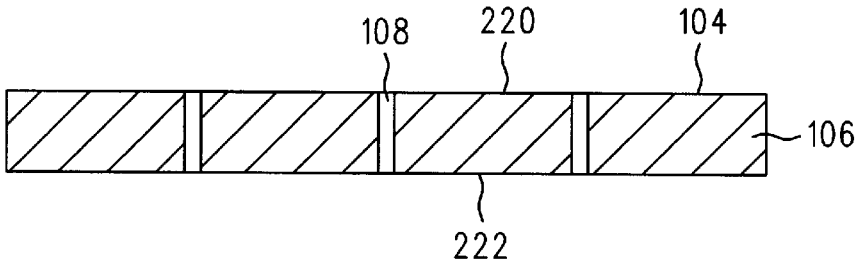
FIG. 3 is a schematically-illustrated cross-sectional view in enlarged format of a representative single component orifice plate member which may be used in accordance with the invention, with the view of FIG. 3 also passing through one row of orifices.

Before providing a detailed discussion of the specialized chemical attachment system of the invention, the orifice plate 104 of the claimed printhead 80 and production process will now be specifically described. With reference to FIG. 2, the orifice plate 104 (which structurally consists of the panel member 106) is cross-sectionally illustrated in enlarged format. The orifice plate 104/panel member 106 in a representative and non-limiting embodiment has an overall thickness "T" (FIG. 2) of about 10–70 microns and is sized to fit over and conform with the substrate 82. However, the present invention shall not be restricted to any particular dimensions in connection with the orifice plate 104, with the invention being prospectively applicable to many different orifice plate units of variable size and shape.

With continued reference to the embodiment of FIG. 2, the orifice plate 104 shown therein is of composite (e.g. multi-component) construction and is specifically comprised of multiple materials which are fixedly secured together to form an integral unit. The orifice plate 104 in FIG. 2 comprises an internal support member 200 of planar construction that is designed to impart strength and durability to the orifice plate 104. The support member 200 will typically have a thickness "$T_1$" (FIG. 2) of about 5–65 microns. Representative and preferred (e.g. non-limiting) materials that may be employed to produce the internal support member 200 include but are not limited to elemental nickel [Ni], palladium/nickel alloys [Pd/Ni], or any other rigid, electroformable metals with engineerable properties. In this regard, the present invention shall not be restricted to any particular construction materials in connection with the internal support member 200. A metallic coating layer 202 is then provided which is preferably applied to all of the exposed surfaces of the internal support member 200 by conventional means including but not limited to electroplating, electroless deposition, sputter deposition, evaporation, and/or chemical vapor deposition (CVD) techniques which are known in the art for this purpose. The metallic coating layer 202 is optimally applied to the side edges 204, 206 of the internal support member 200, as well as the upper and lower surfaces 210, 212 of the support member 200. In a preferred embodiment, the metallic coating layer 202 is even applied to the interior wall 214 of each orifice 108 (FIG. 2). The various characteristics and dimensions of the orifices 108 are discussed above in the previous section, with this information being incorporated by reference in the present section. Likewise, only a small number of orifices 108 are illustrated for example purposes in the above-listed drawing figures, with the present invention not being restricted to any particular number of orifices 108 in the orifice plate 104.

In accordance with the claimed invention, the metallic coating layer 202 will be comprised of at least one elemental noble metal, and particularly the following elemental metals: elemental gold [Au], elemental platinum [Pt], elemental palladium [Pd], and mixtures thereof. Elemental noble metals of the type listed above are employed for this purpose since they provide the following important benefits: (1) general corrosion [e.g. oxidation] resistance; (2) resistance to chemical interactions (e.g. corrosive effects) caused by ink compositions; (3) abrasion resistance; (4) and a high degree of durability, longevity, and structural integrity. In accordance with these benefits, elemental gold is optimally used in connection with the metallic coating layer 202, although the other elemental noble metals listed above (alone or in combination) may likewise be employed in the coating layer 202. However, in the past, it has been difficult to effectively secure the noble metal-containing orifice plate 104 to the underlying components in the printhead (e.g. the barrier layer) using conventional adhesive products. In accordance with the particular chemical characteristics and smooth surface features of noble metal parts constructed from gold, platinum, and/or palladium, these materials would often experience incomplete adhesion during the printhead fabrication process. As a result, the orifice plate 104 was subject to premature detachment and/or displacement, thereby resulting in diminished print quality or printhead failure. The present invention solves this problem in a highly effective manner using a unique chemical coupling system which will be outlined in substantial detail below. It should also be noted that the noble metal coating layer 202 will typically have a uniform thickness "$T_2$" (FIG. 2) at all points on the internal support member 200 of about 0.1–2.5 microns, although this value may be varied, depending on a variety of factors including the type of noble metals being employed and other considerations as assessed by routine preliminary experimentation.

With continued reference to FIG. 2, the completed orifice plate 104 will have a top surface 220 and a bottom surface 222. In accordance with the present invention (and the use of a metallic coating layer 202 applied to the lower surface 212 of the internal support member 200), the bottom surface 222 of the orifice plate 104 shall be considered to be comprised of at least one elemental noble metal as defined above. This situation exists since the coating layer 202 is the outermost layer of exposed material on the bottom surface 222 of the orifice plate 104.

It should also be noted that, in an alternative embodiment (FIG. 3), the orifice plate 104 may have a single-component structure compared with the composite (e.g. multi-component) character of the orifice plate 104 illustrated in FIG. 2. Instead of having an internal support member 200 surrounded by an outer metallic coating layer 202, the orifice plate 104 may instead simply consist of a single, solid panel member 106 (e.g. having orifices 108 therethrough) which is constructed entirely from the noble metal of interest (or mixtures thereof) as previously defined. While the composite structure of FIG. 2 is preferred for strength, durability, and material-cost reasons, the single layer embodiment (FIG. 3) may also be employed wherein the single layer is again constructed from at least one elemental noble metal (e.g. gold, platinum, and/or palladium). Accordingly, all statements herein which indicate that the orifice plate 104 has "a bottom surface comprised of at least one noble metal" shall encompass a structure which includes (1) a noble metal coating (e.g. coating 202) on the internal support member 200 as discussed above and shown in FIG. 2; or (2) a panel member 106 which is constructed entirely of the selected noble metal (FIG. 3) so that the bottom surface 222 thereof will necessarily be comprised of the noble metal. The phrase listed above involving the bottom surface 222 of the orifice plate 104 being comprised of at least one elemental noble metal shall therefore be construed to involve many different orifice plate designs provided that, in some manner, the bottom surface of the selected orifice plate is made of the desired elemental noble metal(s). Likewise, common reference numbers are used in connection with the orifice plates 104 in FIGS. 2—3 to indicate that both plate types are equivalent in structure, function, and purpose with the only difference involving the use of an internal support member 200 in the embodiment of FIG. 2. The dimension information discussed above in connection with the embodiment of FIG. 2 is equally applicable to orifice plate 104 of FIG. 3. Having discussed representative orifice plate structures which may be used in accordance with the invention, attachment of the selected orifice plate 104 to the underlying components of the printhead 80 will now be outlined in substantial detail. Likewise, further information will be provided regarding the particular material layers which are positioned between the orifice plate 104 and the substrate 82 containing the ink ejectors (e.g. resistors 86) thereon. While the following discussion shall be undertaken in connection with the orifice plate 104 illustrated in FIG. 2, it is likewise equally applicable to other orifice plate designs including the design of FIG. 3 (or any other orifice plate having a bottom surface comprised of at least one noble metal).

C. The Orifice Plate Attachment System

Figure 4:
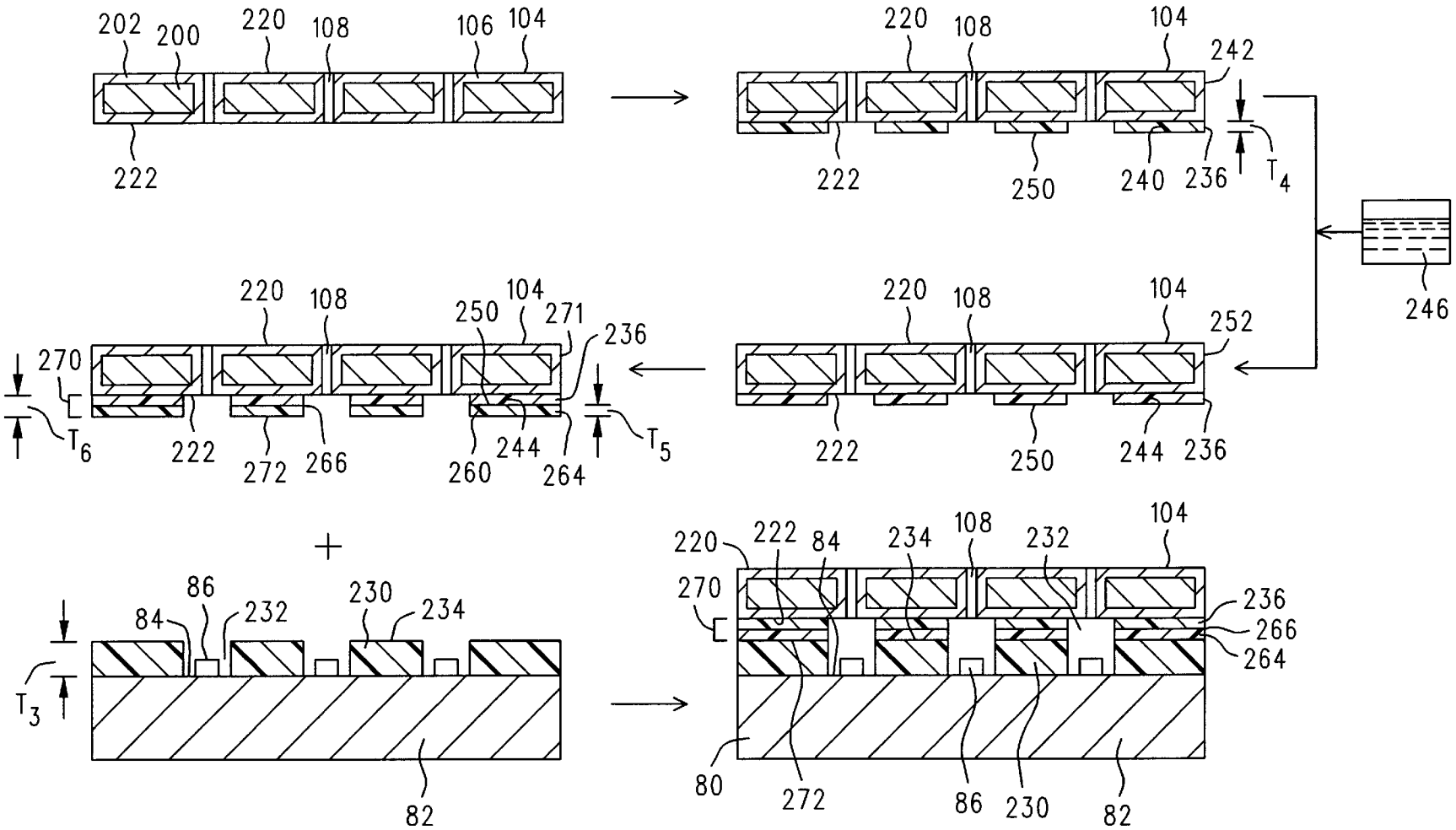
FIG. 4 is a sequential schematic illustration of the process steps which are used to produce the high-durability printhead of the claimed invention, along with a schematic cross-sectional illustration of the completed printhead (which is enlarged for improved clarity).

As illustrated in FIG. 4, the upper surface 84 of the substrate 82 associated with the printhead 80 further comprises an intermediate barrier layer 230 (e.g. a "layer of barrier material") thereon which covers the elongate conductive circuit traces 90 (FIG. 1), but is positioned between and around the ink ejectors (e.g. resistors 86) without covering them. The resistors 86 are illustrated in enlarged format in FIG. 4, with the circuit traces 90 being omitted from FIG. 4 for the sake of clarity. As a result, an ink expulsion/vaporization chamber 232 (FIG. 4) is formed directly above each resistor 86 (or other ink ejector). Again, while the present invention shall be discussed herein with primary reference to thermal inkjet technology, other systems are likewise applicable which incorporate different ink ejectors (e.g. those aside from thin-film heating resistors 86). Within each chamber 232 in a thermal inkjet system, the selected ink materials are heated, vaporized, and subsequently expelled through the orifices 108 in the orifice plate 104.

The barrier layer 230 (which is traditionally produced from conventional organic polymers, photoresist materials, or similar compositions as outlined in U.S. Pat. No. 5,278,584 and discussed above) is applied to the substrate 82 using standard photolithographic techniques or other methods known in the art for this purpose including but not limited to standard lamination, spin coating, roll coating, extrusion coating, curtain coating, and micromolding processes. In addition to clearly defining the ink expulsion/vaporization chambers 232, the barrier layer 230 also functions as a chemical and electrical insulating layer relative to the various components on the upper surface 82 of the substrate 84 (e.g. the conductive traces 90 [FIG. 1]) as well as any transistors [not shown] and the like). Regarding the specific materials which may be employed in connection with the barrier layer 230 (which is optimally produced from one or more organic polymeric compositions as previously noted), representative compounds suitable for fabricating the barrier layer 230 include but are not limited to: 1) dry photoresist films containing half acrylol esters of bis-phenol; 2) epoxy monomers, 3) acrylic and melamine monomers (e.g. which are sold under the trademark "Vacrel" by E.I. DuPont de Nemours and Company of Wilmington, Del. (USA)]; 4) and epoxy-acrylate monomers (e.g. which are sold under the trademark "Parad" by E.I. DuPont de Nemours and Company of Wilmington, Del. (USA)]. However, unless otherwise indicated herein, the claimed invention shall not be restricted to any particular compounds in connection with the barrier layer 230 although materials which are generally classified as photoresists or solder-masks are preferred for this purpose. Likewise, in a non-limiting and representative embodiment, the barrier layer 230 will have a thickness "$T_3$" (FIG. 4) of about 5–30 microns although this value may be varied as needed in accordance with preliminary tests on the printhead 80 being constructed.

After deposition of the barrier layer 230, the unique adhesion/coupling system of the present invention is formed between the upper surface 234 of the barrier layer 230 and the noble metal-containing bottom surface 222 of the orifice plate 104. This highly effective multi-component attachment system (which avoids problems associated with incomplete adhesion to noble metals) will now be discussed with particular reference to the process steps shown schematically in FIGS. 4 and 5.

Step 1

The first step which is employed in attaching the orifice plate 104 to the upper surface 234 of the barrier layer 230 is the coating of at least a portion (and preferably most or all) of the noble metal-containing bottom surface 222 of the orifice plate 104 with a material designated herein as a "mercapto trialkoxy silane composition" in order to form a primary adhesion layer 236 (FIG. 4) comprised of this material which is positioned on the bottom surface 222. The selected mercapto trialkoxy silane composition strongly interacts with the noble metal (especially gold) on the bottom surface 222 of the orifice plate 104 and forms a type of intermetallic bond between the sulfur associated with the mercapto trialkoxy silane composition and the noble metal under consideration. It should be noted at this point that any material layers applied to the bottom surface 222 of the orifice plate 104 shall optimally be applied in such a manner as to avoid blocking the orifices 108.

The term "mercapto trialkoxy silane composition" shall be defined to encompass the following chemical structure:

$$(RO)_3Si(CH_2)_nSH$$

While the present invention shall not be restricted to any particular parameters in connection with "n" and "R" in this formula, a representative and preferred embodiment will involve a composition wherein (1)n=2–6; and (2)R is selected from the group consisting of —$CH_3$ (methyl) and —$CH_2CH_3$ (ethyl).

Figure 5:
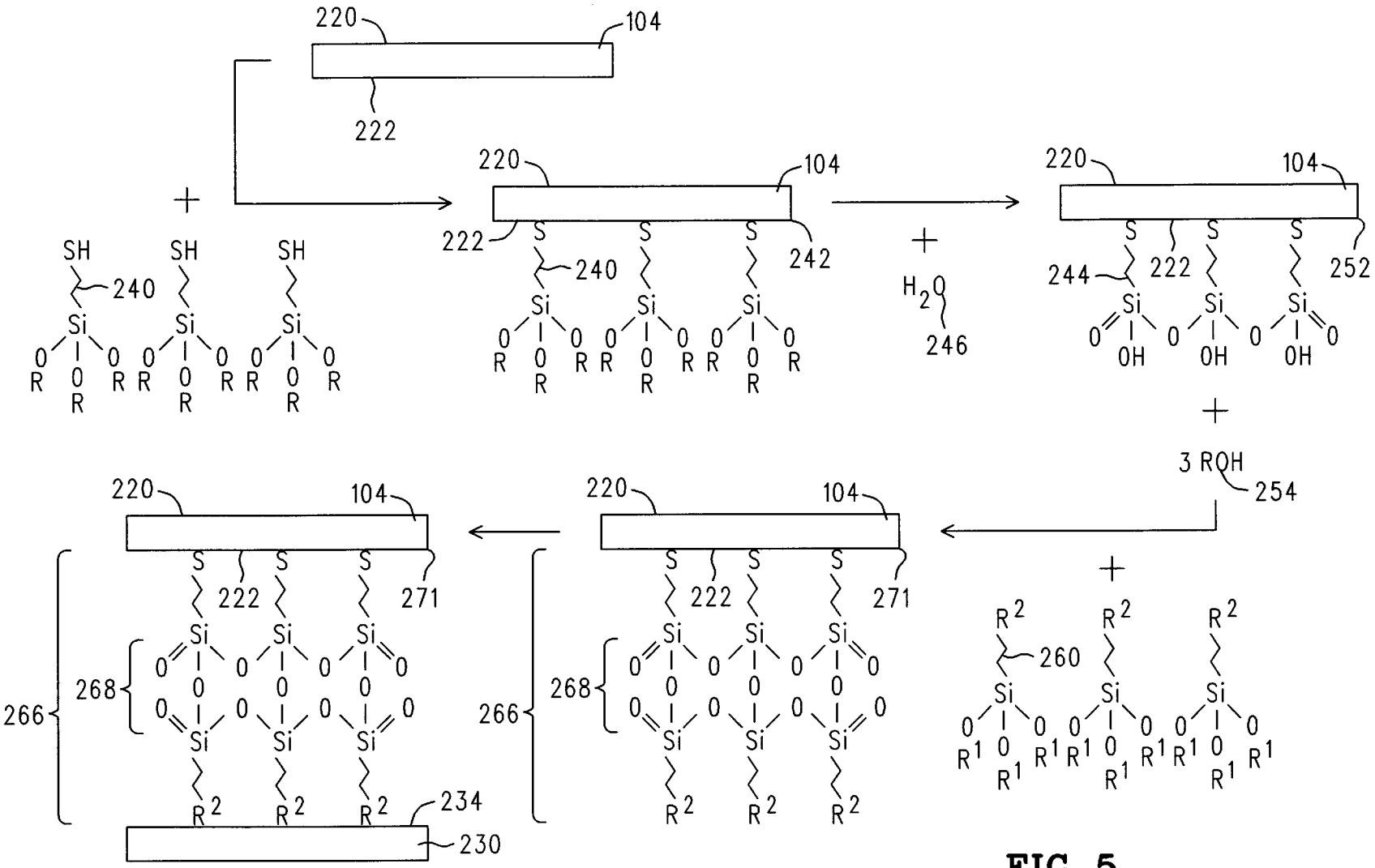
FIG. 5 is a schematic illustration in enlarged format of the specific chemical processes which take place in order to produce the high-durability printhead shown in FIG. 4, with the representative orifice plate and barrier layer being illustrated in non-cross-sectional format (e.g. a side view).

The mercapto trialkoxy silane composition associated with this step of the claimed process is schematically illustrated in FIG. 5 at reference number 240, along with the "attachment" of this material to the bottom surface 222 of the orifice plate 104. While the present invention shall again not be limited to any particular "n" values in connection with the composition 240, n=2 in the illustration presented in FIG. 5. Likewise, for the sake of clarity, the illustrations in FIG. 5 (including the visual representations associated with the orifice plate 104 and substrate 82) are presented in non-cross-sectional format using end views which do not show the orifices 108 in the plate 104 or the resistors 86 on the substrate 82.

Even though the precise chemistry associated with the bonding interactions of the materials described above (e.g. the mercapto trialkoxy silane composition 240 and the noble metal(s) in the bottom surface 222 of the orifice plate 104) are not entirely understood, it is theorized that exceptionally strong adhesion results because of the unique bond formed between the thiol group on the silane composition 240 and the noble metal under consideration. However, the claimed processes shall not be restricted to any particular mechanism associated with the interaction between the mercapto trialkoxy silane composition 240 and the noble metal(s) in the bottom surface 222 of the orifice plate 104 which may involve many different chemical and physical concepts.

Representative mercapto trialkoxy silane compositions 240 as defined above may be obtained from a number of different commercial sources including but not limited to PCR, Incorporated of Gainesville, Fla. (USA) and Gelest, Inc. of Tullytown, Pa. (USA). Likewise, in a preferred and non-limiting embodiment, the primary adhesion layer 236 shown in FIG. 4 which is comprised of the selected mercapto trialkoxy silane composition 240 will have a representative thickness "$T_4$" (FIG. 4) of about 5–500 angstroms, although this range may vary in accordance with numerous factors including the type of mercapto trialkoxy silane composition 240 under consideration as determined by routine preliminary pilot testing. To apply the mercapto trialkoxy silane composition 240 at the desired and appropriate thickness levels as noted above, it is preferred that about $2\times10^{-7}$–$5\times10^{-5}$ g of the selected mercapto trialkoxy silane composition 240 be applied per $cm^2$ of the bottom surface 222 of the orifice plate 104, although this value may likewise be varied as needed. The mercapto trialkoxy silane composition 240 is optimally applied in liquid form, with an exemplary liquid solution of this material consisting of the mercapto trialkoxy silane composition 240 in a $10^4$ to $10^{-2}$ molar concentration within an anhydrous solvent including but not limited to hexane, cyclohexane, methanol, and ethanol. Finally, application of the selected mercapto trialkoxy silane composition 240 in order to form the primary adhesion layer 236 on the bottom surface 222 of the orifice plate 104 may be accomplished using a number of conventional delivery techniques including but not limited to vapor deposition, dip coating, spin coating, and the like, with the claimed processes and products not being restricted to any particular application methods. It should also be noted that the bottom surface 222 of the orifice plate 104 is preferably cleaned in a thorough and complete manner prior to delivery of the mercapto trialkoxy silane composition 240 thereto.

Step 2

The resulting orifice plate 104 having the primary adhesion layer 236 thereon (which forms an intermediate structure designated in FIGS. 4–5 at reference number 242) is then further processed. Specifically, the intermediate structure 242 is treated in order to chemically "convert" the mercapto trialkoxy silane composition 240 which is bound to the noble metal-containing bottom surface 222 of the orifice plate 104 into a product defined herein as a "mercapto oxysilane polymer". This material is schematically shown in FIGS. 4–5 at reference number 244. As indicated below, the mercapto oxysilane polymer 244 actually involves a dealkoxylated mercapto silane which, through the formation of multiple reactive hydroxyl groups thereon, polymerizes to generate the mercapto oxysilane polymer 244 in the primary adhesion layer 236.

To accomplish chemical conversion of the mercapto trialkoxy silane composition 240 to the mercapto oxysilane polymer 244, a preferred method involves the application of a supply of water 246 (FIGS. 4–5) to the primary adhesion layer 236 (and the mercapto trialkoxy silane composition 240 therein). This may be accomplished in many different ways, with the present invention not being restricted to any particular water application methods. For example, the intermediate structure 242 having the primary adhesion layer 236 thereon may immersed within a water-containing vessel for a period of about 5–300 seconds at ambient temperature levels (e.g. about 20–23° C.) to accomplish conversion. The outer surface 250 of the primary adhesion layer 236 (FIG. 4) may also be sprayed with a water-containing mist for a period of about 5–10 seconds at ambient temperature levels (e.g. about 20–23° C.) to achieve conversion. However, in a preferred embodiment, the intermediate structure 242 having the primary adhesion layer 236 thereon may be placed in contact with steam (100° C.) for a period of about 5–10 seconds in a sealed chamber of conventional design, with the added heat accelerating the conversion reaction. As the steam contacts the outer surface 250 of the primary adhesion layer 236, conversion takes place. It should also be noted that any of the other water application techniques listed above may likewise be undertaken at elevated temperature levels (e.g. up to about 100° C.) if needed and desired as determined by preliminary pilot testing. It is therefore important to emphasize that any water application method may be employed at this stage of the claimed process provided that, in some manner, the outer surface 250 of the primary adhesion layer 236 which contains the mercapto trialkoxy silane composition 240 is placed in physical contact with the supply of water 246 (which is in vapor or liquid form). As a result of this step, a modified intermediate structure 252 is generated (FIGS. 4–5) which consists of the orifice plate 104 having the primary adhesion layer 236 on the noble metal-containing bottom surface 222, with the primary adhesion layer 236 now containing the claimed mercapto oxysilane polymer 244 (FIG. 4). Regarding the ultimate amount of water which is employed in the conversion process (which also yields an alcohol [ROH] shown at reference number 254 in FIG. 5), this value may be varied as needed in accordance with preliminary pilot studies on the materials and compositions under consideration. In a representative and non-limiting embodiment, adequate results will be achieved if about $10^{-7}$ to $10^{-8}$ g of water 246 is applied per $cm^2$ of the orifice plate 104 (e.g. the bottom surface 222 containing the primary adhesion layer 236 thereon).

It should also be noted that production of the mercapto oxysilane polymer 244 may be undertaken (1) after application and bonding of the initial mercapto trialkoxy silane composition 240 to the noble metal-containing bottom surface 222 of the orifice plate 104 as discussed above (e.g. using the claimed water conversion process); or (2) prior to delivery of the mercapto trialkoxy silane composition 240 to the bottom surface 222 of the orifice plate 104. When process (2) is involved, the mercapto trialkoxy silane composition 240 is preferably converted to the desired mercapto oxysilane polymer 244 by combining the initial mercapto trialkoxy silane composition 240 (e.g. in liquid form as discussed above) with an aqueous alcohol solution (e.g. 95% by weight ethanol and 5% by weight water). As a result, the mercapto oxysilane polymer 244 is produced which is thereafter delivered to the bottom surface 222 of the orifice plate member 104 using the same delivery techniques, solution characteristics, and quantities listed above in connection with delivery of the mercapto trialkoxy silane composition 240 to the bottom surface 222. All of the application parameters provided above in connection with delivery of the mercapto trialkoxy silane composition 240 to the orifice plate 104 are incorporated by reference in connection with the delivery of "premanufactured" amounts of the mercapto oxysilane polymer 244 to the bottom surface 222 of the orifice plate 104. For example, as noted above in connection with the mercapto trialkoxy silane composition 240, about $2\times10^{-7}$ to $5\times10^{-5}$ g of the premanufactured mercapto oxysilane polymer 244 will optimally be delivered per $cm^2$ of the orifice plate 104 (e.g. the bottom surface 222 thereof). As a result, the modified intermediate structure 252 discussed above is produced, with this structure 252 comprising the orifice plate 104 having the primary adhesion layer 236 on the bottom surface 222. The primary adhesion layer will contain the mercapto oxysilane polymer 244 bound thereto in accordance with the proposed mechanism listed above in the primary embodiment of the invention, namely, intermetallic bonding between (1) the sulfur groups associated with the mercapto oxysilane polymer 244; and (2) and the noble metal(s) in the bottom surface 222 of the plate 104. Regardless of which method is ultimately selected to generate the modified intermediate structure 252, both of the foregoing techniques shall be deemed equivalent in function, result, and operative effect since they each involve the production of an orifice plate 104 having a primary adhesion layer 236 thereon which is comprised of at least one mercapto oxysilane polymer 244.

Step 3

The next step in the production process involves coating at least a portion (and preferably most or all) of the primary adhesion layer 236 on the bottom surface 222 of the orifice plate 104 with at least one material known as a "trialkoxy silane coupling agent". This composition (which is schematically illustrated at reference number 260 in FIGS. 4–5) has the following formula:

$$(R^1O)_3Si(CH_2)_mR^2$$

While the present invention shall again not be restricted to any particular parameters associated with this material, "m" will optimally be between about 2–6. In the example of FIG. 5, m=2. Likewise, in a preferred and non-limiting embodiment, the trialkoxy silane coupling agent 260 will involve a composition wherein (1) $R^1$ is selected from the group consisting of —$CH_3$ (methyl) and —$CH_2CH_3$ (ethyl); and (2) $R^2$ is selected from the following group:

A) —CN (cyano)

B) —OH (hydroxy)

C) —SH (mercapto)

D) —OCN (isocyanato)

E) —$NH_2$ (amino)

F) —$HC{=}CH_2$ (allyl)

G) —$OC(=O)CH_3$ (acetoxy)

H) —$OC(=O)CH{=}CH_2$ (acryloxy)

I) —$C(=O)OCH_3$ (carbomethoxy)

J) —$OC(=O)C(CH_3){=}CH_2$ (methylmethacrylate)

K) —$OH_2CHC$—$CH_2$ (glycidoxy)

Regarding $R^2$, this group may be chosen with particular attention to the chemical composition used to produce the barrier layer 230 so that strong, secure, and permanent adhesion of these components can take place. All of the $R^2$ groups listed above should be sufficient to provide permanent adhesion to the barrier materials which are typically chosen for use as the barrier layer 230 (including those recited above). The selection of any particular $R^2$ groups will be undertaken in accordance with preliminary studies on the specific materials employed to produce the barrier layer 230 so that maximum adhesion is ensured. In this regard, the claimed invention shall not be restricted to any specific constituents in connection with the variables m, $R^1$, and $R^2$ in the above-described formula which may involve many different chemical components and groups. Nonetheless, by way of example, coupling agents 260 containing acryloxy and methylmethacrylate $R^2$ groups will work well with barrier layers 230 that contain acrylate monomers. Effective results are likewise achieved when epoxy monomer-containing barrier layers 230 are used in connection with glycidoxy $R^2$ groups. Allyl $R^2$ groups will work well with both epoxy and acrylate monomer-type barrier layers 230. Finally, effective results are achieved when amino $R^2$ groups are used in connection with polyimide-containing barrier layers 230. However, the present invention shall again not be restricted to any particular $R^2$ group-barrier material combinations with optimum results being determined in accordance with routine preliminary testing.

The representative trialkoxy silane coupling agents 260 discussed above may be obtained from a number of different commercial sources including but not limited to PCR Incorporated of Gainesville, Fla. (USA) and Gelest, Inc. of Tullytown, Pa. (USA). In a preferred and non-limiting embodiment, the selected trialkoxy silane coupling agent 260 is applied to at least part (and preferably most or all) of the outer surface 250 of the primary adhesion layer 236 shown in FIG. 4 (which is comprised of the previously-formed mercapto oxysilane polymer 244) to produce a secondary adhesion layer 264. The secondary adhesion layer 264 will have a representative and non-limiting thickness "$T_5$" (FIG. 4) of about 5–500 angstroms although this range may vary in accordance with numerous factors including the type of trialkoxy silane coupling agent 260 under consideration. The trialkoxy silane coupling agent 260 is optimally applied in liquid form, with an exemplary liquid solution of this material consisting of the coupling agent 260 in a $10^{-4}$ to $10^{-2}$ molar concentration within an anhydrous solvent including but not limited to hexane, cyclohexane, methanol, and ethanol. To accomplish effective delivery of the trialkoxy silane coupling agent 260 at the desired and appropriate thickness levels listed above, it is likewise preferred that about $1\times10^{-7}$ to $2\times10^{-5}$ g of the trialkoxy silane coupling agent 260 (in liquid form as previously noted) be applied per $cm^2$ of the outer surface 250 of the primary adhesion layer 236, although this value may likewise be varied as needed. Finally, application of the selected trialkoxy silane coupling agent 260 to form the secondary adhesion layer 264 may be accomplished using a number of conventional techniques including but not limited to vapor deposition, dip coating, spin coating, and the like, with the claimed processes and products not being restricted to any given application methods.

Once this step is performed, a reaction product resulting from the combination of (1) the trialkoxy silane coupling agent 260 in the secondary adhesion layer 264; and (2) the mercapto oxysilane polymer 244 in the primary adhesion layer 236 is produced which is illustrated at reference number 266 in FIGS. 4–5. The reaction product 266 (which does not have a traditional chemical name under current and established nomenclature) basically involves the structure shown schematically in FIG. 5. In effect, the reaction product 266 consists of a type of "bi-layer" interlinked composition formed by a reaction of the alkoxy groups on the trialkoxy silane coupling agent 260 with the hydroxyl groups on the mercapto oxysilane polymer 244 to form a central oxygen network shown schematically in FIG. 5 at reference number 268. The reaction product 266 shall be designated herein as a "composite adhesive layer" or "portion of composite adhesive material" shown at reference number 270 in FIG. 4. The composite adhesive layer 270 will have an overall thickness "$T_6$" (FIG. 4) of about 10–1000 angstroms in a preferred embodiment, although this value may be varied as needed and desired in accordance with preliminary pilot testing. It is likewise important to emphasize that the unique "bi-layer" chemical network associated with the reaction product 266 in the composite adhesive layer 270 contributes substantially to the overall desirable adhesion capabilities of the claimed coupling system. In particular, the strong adhesion capabilities of the claimed system result from (1) the bonds formed between the thiol groups and noble metals of interest as previously noted; (2) the Si-O-Si bonds formed between the claimed compositions (FIG. 5); and (3) the covalent bonds between the layer of barrier material 230 and the functional group $R^2$ associated with the coupling agent 260. Furthermore, during application of the primary and secondary adhesion layers 236, 264 to form the composite adhesive layer 270, such materials shall again be selectively applied to the bottom surface 222 of the orifice plate 104 so that they do not cover (e.g. block) the orifices 108. This step results in a product designated herein as a composite adhesive-coated structure 271 (FIGS. 4–5) consisting of the orifice plate 104 having the bottom surface 222 coated with the composite adhesive material 270.

Step 4

The final step in the claimed process involves placing the exterior surface 272 (FIG. 4) of the composite adhesive layer 270 on the orifice plate member 104 in direct physical contact with the upper surface 234 of the barrier layer 230. This may be accomplished by urging the secondary adhesion layer 264 on the orifice plate 104 (which forms the outermost part of the composite adhesive layer 270) toward and against the upper surface 234 of the barrier layer 230 which will result in adhesion of the barrier layer 230 to the orifice plate 104. While the adhesion process is not entirely understood, it is believed that the $R^2$ group on the trialkoxy silane coupling agent 260 chemically interacts with organic constituents in the barrier layer 230 to cause adhesion of these items together. In an optimum embodiment, the foregoing adhesion process preferably occurs under high pressure and temperature conditions which may be achieved in any conventional manner including, for example, the use of a standard heated laminating apparatus which is known in the art for circuit fabrication purposes. While the present invention shall not be restricted to any particular temperature and pressure conditions, it is preferred that, during physical engagement between the treated orifice plate 104 and the layer of barrier material 230, both of these components be subjected (e.g. heated) to a temperature of about 160–350° C., with pressure levels of about 75–250 psi being exerted on such components. The exact temperature and pressure levels to be employed in a given situation may be determined in accordance with preliminary pilot tests taking into consideration the type of material being used in the barrier layer 230. For example, optimum results are achieved in connection with epoxy-acrylate monomers when a pressure of about 75–150 psi and temperature of about 160–225° C. are employed.

The completed printhead 80 (minus the flexible circuit member 118) is shown cross-sectionally in FIG. 4. The finished printhead 80 will specifically contain the following elements: (1) the substrate 82 having an upper surface 84, with the upper surface 84 including at least one ink ejector (e.g. a resistor 86 if a thermal inkjet system is involved); (2) a barrier layer 230 positioned on at least a portion of the upper surface 84 of the substrate 82; (3) a portion or supply of adhesive material in the form of a composite adhesive layer 270 as defined above which is placed on at least part of the barrier layer 230, with the composite adhesive layer 270 being comprised of a reaction product formed by a combination of the mercapto oxysilane polymer 244 and the selected trialkoxy silane coupling agent 260; and (4) the orifice plate 104 having at least one orifice 108 therethrough and a bottom surface 222 comprised of at least one elemental noble metal as defined above (e.g. gold, platinum, and/or palladium), with the bottom surface 222 being affixed to the composite adhesive layer 270 so that the adhesive material associated therewith is positioned between the orifice plate 104 and the barrier layer 230. This structure (e.g. the completed printhead 80 illustrated in FIG. 4) is durable, shock resistant, and avoids problems associated with corrosion/oxidation. Regarding the corrosion resistance of the claimed printhead 80, it can be used in connection with a wide variety of different ink compositions 32 (FIG. 1) including but not limited to those listed in U.S. Pat. No. 4,963,189 to Hindagolla (which involves black ink products), as well as colored ink materials of the type described in U.S. Pat. No. 5,198,023 to Stoffel. However, it is important to emphasize that the present invention (e.g. the completed printhead 80 and cartridge 10) shall not be restricted to the delivery of any particular ink compositions. Likewise, the printhead 80 of the invention is suitable for use with a number of ink cartridge systems including those in which the printhead 80 is directly affixed to the cartridge housing (e.g. housing 12 shown in FIG. 1) or operatively connected via one or more tubular ink transfer conduits to a remotely-positioned ink storage vessel (not shown). Regarding use of the printhead 80 in connection with the cartridge 10, assembly may be achieved as discussed above or in any other manner wherein the printhead 80 is secured to the cartridge 10 so that the printhead 80 is in fluid communication with the ink retaining compartment 30 in the housing 12. This may be accomplished by the use of conventional adhesive materials (e.g. epoxy resin compounds known in the art for this purpose) which are applied to (1) the housing 12; and (2) one or more of the substrate 82, flexible circuit member 118, and orifice plate 104 as needed in accordance with the particular cartridge 10 under consideration.

The present invention represents an advance in the art of printhead construction by providing a printhead system in which the orifice plate and barrier layer are securely affixed together in a manner which is permanent and substantially improved compared with prior attachment systems. The claimed invention (which greatly facilitates the use of noble metal orifice plates) also provides a number of important general benefits. These benefits include but are not limited to: (1) a greater degree of strength, durability, and shock resistance; (2) improved printhead longevity; (3) more uniform print quality and reliability over the life of the printhead and ink cartridge; (4) enhanced corrosion resistance; (5) the ability to use noble metal orifice plates without premature detachment and/or displacement of these components from the remaining portions of the printhead; and (6) a greater level of overall structural integrity. For these reasons, the claimed products and processes represent important developments in printing technology which generally create more efficient and economical printing systems. It should also be noted that the chemical attachment system discussed herein is likewise prospectively applicable to the attachment of other components together in ink cartridge printheads which are constructed of similar metal materials.

Having herein set forth preferred embodiments of the invention, it is anticipated that suitable modifications may be made thereto by individuals skilled in the relevant art which nonetheless remain within the scope of the invention. For example, the invention shall not be limited to any particular cartridge unit types, ink ejectors, and operational parameters within the general guidelines set forth above. Likewise, unless otherwise indicated herein, the invention shall not be restricted to any particular dimensions and construction materials. The present invention shall therefore only be construed in accordance with the following claims:

The invention that is claimed is:

1. A method for producing a high-durability printhead for use in an ink cartridge comprising the steps of:

providing a substrate comprising an upper surface, said upper surface comprising at least one ink ejector thereon for expelling ink on-demand from said printhead and a layer of barrier material positioned on at least a portion of said upper surface of said substrate;

providing an orifice plate member comprising a bottom surface and at least one opening passing through said orifice plate member, said bottom surface of said orifice plate member being comprised of at least one elemental noble metal selected from the group consisting of gold, platinum, palladium, and mixtures thereof;

coating at least a portion of said bottom surface of said orifice plate member with a mercapto trialkoxy silane composition in order to form a primary adhesion layer on said bottom surface of said orifice plate member;

chemically converting said mercapto trialkoxy silane composition in said primary adhesion layer to a mercapto oxysilane polymer composition;

coating at least a portion of said primary adhesion layer with a trialkoxy silane coupling agent in order to form a secondary adhesion layer positioned on said primary adhesion layer and chemically bonded thereto, said primary adhesion layer and said secondary adhesion layer combining to form a composite adhesive layer secured to said bottom surface of said orifice plate member; and placing said composite adhesive layer secured to said bottom surface of said orifice plate member in contact with said layer of barrier material in order to securely affix said orifice plate member to said layer of barrier material and thereby produce said high-durability printhead.

2. The method of claim 1 wherein said chemically converting of said mercapto trialkoxy silane composition in said primary adhesion layer to said mercapto oxysilane polymer composition comprises applying $H_2O$ to said primary adhesion layer.

3. The method of claim 2 wherein said applying of said $H_2O$ to said primary adhesion layer on said orifice plate member comprises placing said primary adhesion layer in contact with a supply of steam.

4. The method of claim 1 wherein said mercapto trialkoxy silane composition comprises the following chemical compound:

$$(RO)_3Si(CH_2)_nSH$$

wherein n=2–6, and R is selected from the group consisting of —$CH_3$ and —$CH_2CH_3$.

5. The method of claim 1 wherein said trialkoxy silane coupling agent comprises the following chemical compound:

$$(R^1O)_3Si(CH_2)_mR^2$$

wherein m=2–6, $R^1$ is selected from the group consisting of —$CH_3$ and —$CH_2CH_3$, and $R^2$ is selected from the group consisting of cyano, hydroxy, acryloxy, acetoxy, allyl, amino, mercapto, methylmethacrylate, isocyanato, carbomethoxy, and glycidoxy groups.

6. The method of claim 1 wherein said ink ejector comprises at least one resistor.

7. A method for producing a high-durability printhead for use in an ink cartridge comprising the steps of:

providing a substrate comprising an upper surface, said upper surface comprising at least one ink ejector thereon for expelling ink on-demand from said printhead and a layer of barrier material positioned on at least a portion of said upper surface of said substrate;

providing an orifice plate member comprising a bottom surface and at least one opening passing through said orifice plate member, said bottom surface of said orifice plate member being comprised of at least one elemental noble metal selected from the group consisting of gold, platinum, palladium, and mixtures thereof, said bottom surface also being at least partially coated with a primary adhesion layer comprised of a mercapto oxysilane polymer composition;

coating at least a portion of said primary adhesion layer with a trialkoxy silane coupling agent in order to form a secondary adhesion layer positioned on said primary adhesion layer and chemically bonded thereto, said primary adhesion layer and said secondary adhesion layer combining to form a composite adhesive layer secured to said bottom surface of said orifice plate member; and placing said composite adhesive layer secured to said bottom surface of said orifice plate member in contact with said layer of barrier material in order to securely affix said orifice plate member to said layer of barrier material and thereby produce said high-durability printhead.

8. The method of claim 7 wherein said trialkoxy silane coupling agent comprises the following chemical compound:

$$(R^1O)_3Si(CH_2)_mR^2$$

wherein m=2–6, $R^1$ is selected from the group consisting of —$CH_3$ and —$CH_2CH_3$, and $R^2$ is selected from the group consisting of cyano, hydroxy, acryloxy, acetoxy, allyl, amino, mercapto, methylmethacrylate, isocyanato, carbomethoxy, and glycidoxy groups.

9. The method of claim 7 wherein said ink ejector comprises at least one resistor.

10. A high-durability printhead for use in an ink cartridge comprising:

a substrate comprising an upper surface, said upper surface comprising at least one ink ejector thereon for expelling ink on-demand from said printhead;

a layer of barrier material positioned on at least a portion of said upper surface of said substrate;

a supply of adhesive material positioned on at least part of said layer of barrier material, said adhesive material being comprised of a reaction product formed by a combination of a mercapto oxysilane polymer composition and a trialkoxy silane coupling agent; and an orifice plate member comprising at least one opening therethrough and a bottom surface comprised of at least one elemental noble metal selected from the group consisting of gold, platinum, palladium, and mixtures thereof, said bottom surface of said orifice plate member being affixed to said adhesive material so that said adhesive material is positioned between said orifice plate member and said layer of barrier material.

11. The printhead of claim 10 wherein said ink ejector comprises at least one resistor.

12. An ink cartridge comprising:

a housing comprising a compartment therein; and a high-durability printhead in fluid communication with said compartment, said printhead comprising:

a substrate comprising an upper surface, said upper surface comprising at least one ink ejector thereon for expelling ink on-demand from said printhead;

a layer of barrier material positioned on at least a portion of said upper surface of said substrate;

a supply of adhesive material positioned on at least part of said layer of barrier material, said adhesive material being comprised of a reaction product formed by a combination of a mercapto oxysilane polymer composition and a trialkoxy silane coupling agent; and an orifice plate member comprising at least one opening therethrough and a bottom surface comprised of at least one elemental noble metal selected from the group consisting of gold, platinum, palladium, and mixtures thereof, said bottom surface of said orifice plate member being affixed to said adhesive material so that said adhesive material is positioned between said orifice plate member and said layer of barrier material.

13. The ink cartridge of claim 12 wherein said ink ejector comprises at least one resistor.

* * * * *